US005818340A

United States Patent [19]

Yankielun et al.

[11] Patent Number: 5,818,340

[45] Date of Patent: Oct. 6, 1998

[54] ROOF MOISTURE SENSING SYSTEM AND METHOD FOR DETERMINING PRESENCE OF MOISTURE IN A ROOF STUCTURE

[75] Inventors: Norbert E. Yankielun, Lebanon, N.H.; Stephen N. Flanders, Norwich, Vt.

[73] Assignee: The United States of America as represented by the Secretary of the Army, Washington, D.C.

[21] Appl. No.: 621,391

[22] Filed: Mar. 25, 1996

[51] Int. Cl.[6] ..... G08B 21/00

[52] U.S. Cl. ..... 340/602; 340/539; 340/601; 340/604; 364/556; 324/696

[58] Field of Search ..... 340/602, 601, 340/604, 605, 539; 250/390.05; 364/556, 550; 73/83, 592; 318/483; 324/696; 200/61.04, 61.05; 52/173.1

[56] References Cited

U.S. PATENT DOCUMENTS

| | | | |
|---|---|---|---|
| 4,110,945 | 9/1978 | Sheahan | 340/601 |
| 4,254,472 | 3/1981 | Juengel et al. | 364/556 |
| 4,502,044 | 2/1985 | Farris et al. | 340/604 |
| 4,542,472 | 9/1985 | Toms, II | 364/556 |
| 4,598,273 | 7/1986 | Bryan ey al. | 340/539 |
| 4,692,752 | 9/1987 | Abel | 340/604 |
| 4,924,174 | 5/1990 | Sheahan | 324/696 |
| 4,965,554 | 10/1990 | Darling | 340/604 |
| 5,136,285 | 8/1992 | Okuyama | 340/539 |
| 5,193,390 | 3/1993 | Nill | 73/335.02 |
| 5,381,136 | 1/1995 | Powers et al. | 340/539 |
| 5,402,075 | 3/1995 | Lu et al. | 340/602 |
| 5,459,403 | 10/1995 | Kohler et al. | 324/643 |
| 5,463,377 | 10/1995 | Kronbeg | 340/605 |

*Primary Examiner*—Jeffery Hofsass
*Assistant Examiner*—John Tweel, Jr.
*Attorney, Agent, or Firm*—Luther A. Marsh

[57] ABSTRACT

A roof moisture sensing system includes (1) a radio frequency pulse transmitter, (2) a moisture sensor disposed on a roof, and (3) a radio receiver adapted to monitor resonance of the moisture sensor activated by a pulse transmitted by the pulse transmitter. The receiver is adapted to analyze the resonance of the sensor to determine the presence of moisture in the sensor. The transmitter and the receiver can be remote from the sensor and the roof.

15 Claims, 3 Drawing Sheets

ROOF MOISTURE SENSING SYSTEM AND METHOD FOR DETERMINING PRESENCE OF MOISTURE IN A ROOF STUCTURE

BACKGROUND OF THE INVENTION

1. Field of the Invention

This invention relates to detection systems and is directed more particularly to a system and method for detecting moisture in roofs.

2. Description of the Prior Art

Current non-destructive methods for determining the presence of moisture in roof structures include (1) infrared thermographic, and (2) nuclear moisture meter detection of moist insulation. Both methods require that a team of people go onto the roof, or above the roof, as in the case of aerial thermography. Each method detects moisture indirectly, from the level of heat released, or by the backscatter of slow neutrons from hydrogen atoms. Each method provides no information until the inspection is scheduled and completed.

In U.S. Pat. No. 4,598,273, issued Jul. 1, 1986, in the name of Bynum O. Bryan, et al, there is disclosed a leak detection system in which water-activated batteries power autonomous transmitters mounted on a roof top. When a battery becomes wet, an associated transmitter sends a signal which indicates wetting and identifies the location of the transmitter. However, upon wetting the batteries expend their energy and must be replaced. Further, there is no provision for testing the sensors non-destructively in situ. Therefore, false readings eventually occur. Still further, the batteries have a limited shelf life and must be replaced even when not activated for long periods of time. The number of transmitters involved, and the continuous replacement of batteries, renders the Bryan system unduly expensive.

There is thus a need for a relatively inexpensive moisture sensing system which does not require people on or above the roof to operate, and which does not require continuous attention and/or replacement of parts to be kept in active service, but which does provide for inspection from remote locations to determine whether moisture is present in a roof structure.

There is further a need for an improved method for detecting moisture in a roof structure.

SUMMARY OF THE INVENTION

An object of the invention is, therefore, to provide a roof moisture sensing system which is relatively inexpensive, does not require people on or above the roof to conduct an inspection of the roof, does not require continuous attention and/or replacement of parts, such as batteries, and which recovers to its original condition upon drying; such that the moisture sensors may be used again and again and do not expend themselves when wetted.

A further object of the invention is to provide an improved method for detecting moisture in a roof structure.

With the above and other objects in view, as will hereinafter appear, a feature of the invention is the provision of a roof moisture sensing system comprising a radio frequency pulse transmitter, a moisture sensor disposed on a roof, and a radio receiver adapted to monitor resonance of the moisture sensor activated by a pulse transmitted by the pulse transmitter. The receiver is adapted to analyze the resonance of the sensor to determine the presence of moisture in the sensor. The transmitter and the receiver may be remote from the sensor and from the roof.

In accordance with a further feature of the invention, there is provided a method for determining the presence of moisture in a roof structure. The method comprises the steps of providing a moisture sensor on the roof structure, the moisture sensor comprising an inductor and a capacitor, the capacitor comprising first and second electrodes and water-absorptive material, or air, disposed therebetween, and the inductor comprising an induction coil. The first and second electrodes are in electrical communication with first and second ends of the induction coil. The capacitor is adapted to change the resonant frequency of the sensor in response to wetting of the capacitor water-absorptive material. The method further includes the steps of directing radio frequency power at the sensor to actuate resonance of the sensor, and monitoring resonant frequency signals emitted by the sensor to determine thereby whether the sensor is dry or wet.

The above and other features of the invention, including various novel details of construction and combinations of parts, will now be more particularly described with reference to the accompanying drawings and pointed out in the claims. It will be understood that the particular systems and methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
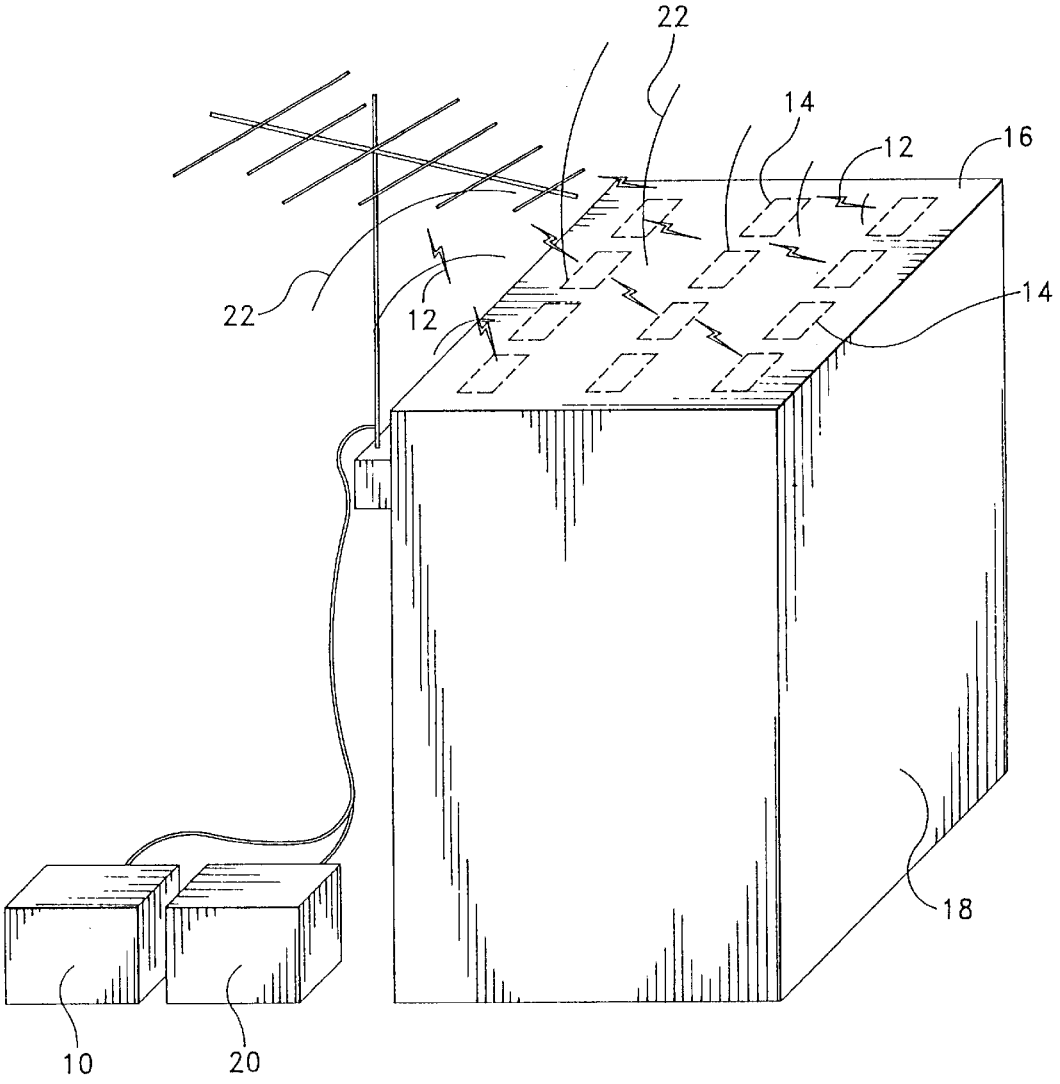
FIG. 1 is a diagrammatic representation of one form of roof moisture sensing system illustrative of an embodiment of the invention.

Referring to FIG. 1, it will be seen that an illustrative embodiment of the inventive system includes (1) a radio frequency (RF) radio transmitter 10 adapted to transmit pulses of RF signals 12, (2) one or more moisture sensors 14 disposed on a roof structure 16 of a structure 18 and resonantly activatable by the pulses of signals 12, and (3) a radio receiver and analyzer 20 adapted to receive and analyze resonant signals 22 from the sensors 14 to determine whether the roof structure 16 contains a substantial amount of moisture.

Figure 2:
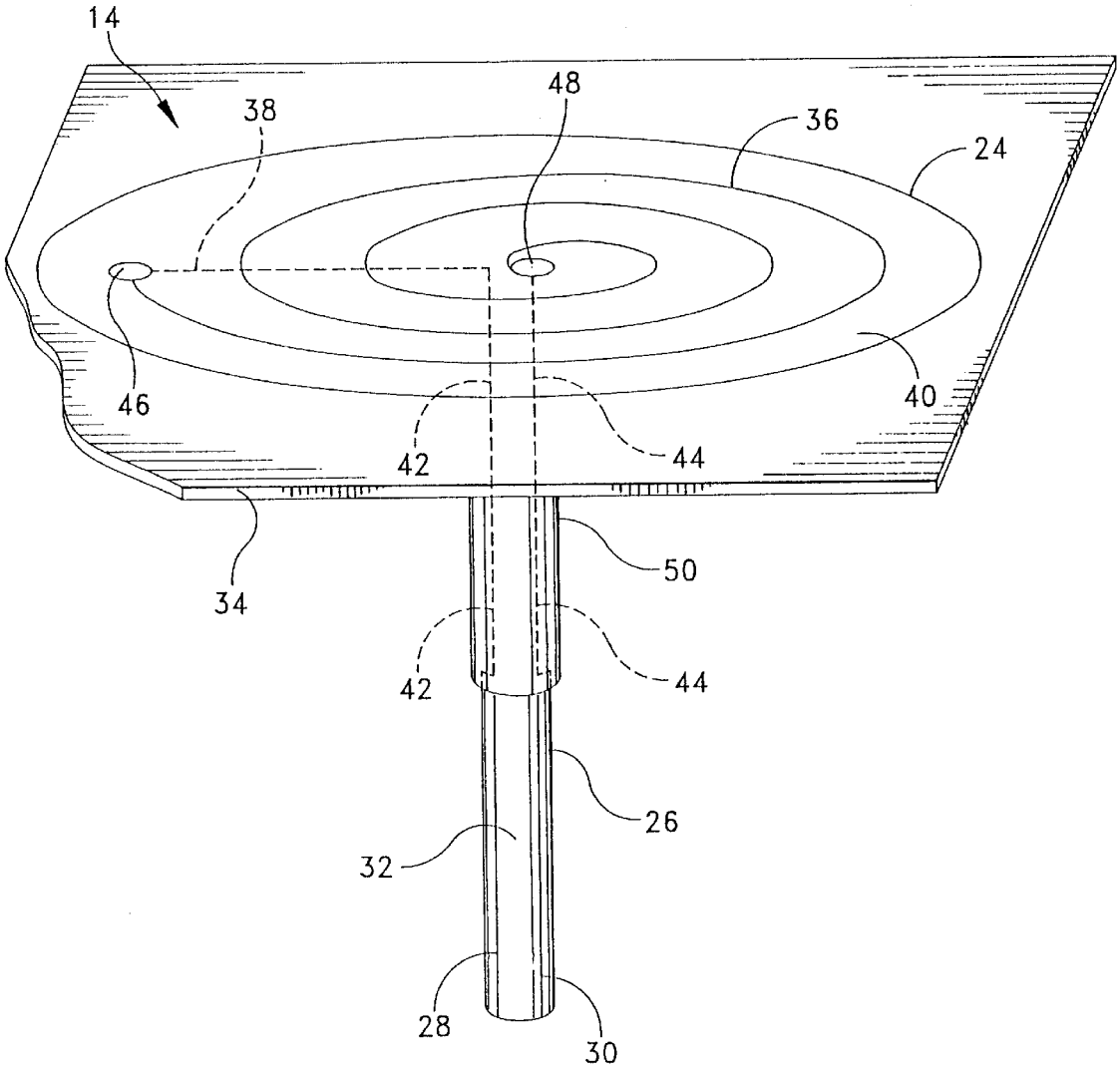
FIG. 2 is a perspective view of a roof moisture sensing sensor comprising a component of the system of FIG. 1.

Referring to FIG. 2, it will be seen that the moisture sensors 14 each comprise an inductor 24 and a capacitor 26. The capacitor 26 includes first and second electrode plates 28, 30 and a water-absorptive material 32 disposed therebetween. The inductor 24 includes a substantially flat non-conductive plate 34 having an induction coil 36, which may be a printed circuit, covered with a plastic film 40.

Still referring to FIG. 2, it will be seen that the first and second electrode plates 28, 30 of the capacitor 26 are in electrical communication, as by wires 42, 44 with first and second ends 46, 48 of the induction coil 36. A portion 38 of the wire 42, extending to the induction coil first end 46, may comprise a printed circuit bridged through the plate 34 to the coil end 46.

The moisture sensor 14 may include a stem member 50 interconnecting the inductor 24 and the capacitor 26. The stem member 50 is of a rigid material, preferably of a tubular configuration, with the wires 42, 44 passing therethrough.

Figure 3:
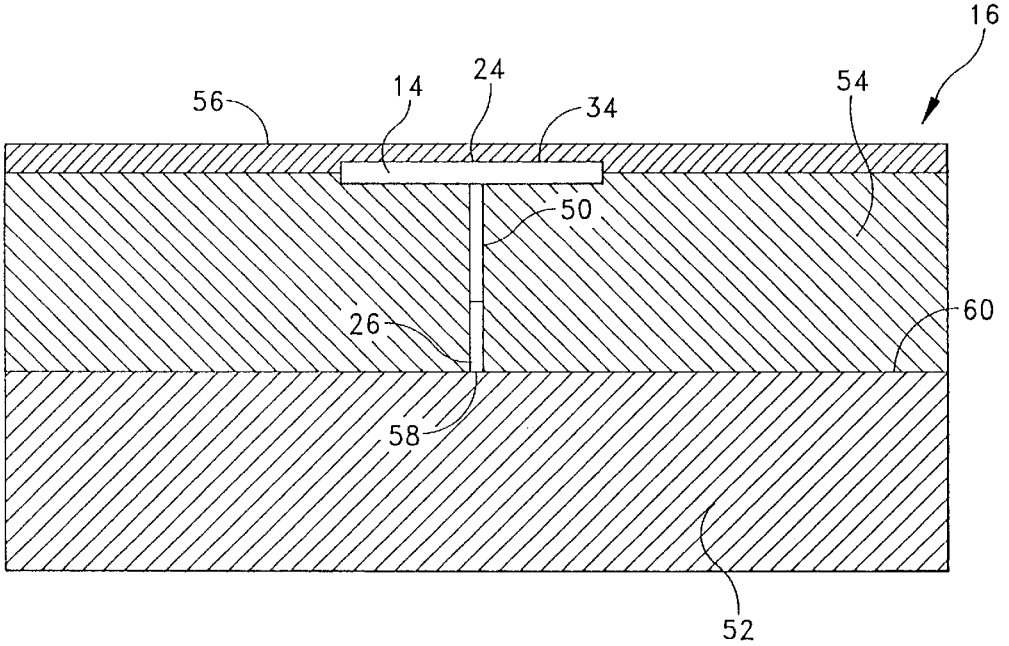
FIG. 3 is a diagrammatic sectional view of the sensor of FIG. 2 in combination with roof top components.

Referring to FIG. 3, it will be seen that a roof 16, of the type in which the moisture sensing system finds utility, typically is a flat roof, or low-slope roof (not shown) where water sometimes reaches a flaw in the water proof membrane, and seeps into the roof structure. In the illustrative example shown in FIG. 3, the roof structure 16 includes a substrate layer 52, which may be cement, or the like, an insulation layer 54, a membrane layer 56, which may be tar paper, or the like, and a ballast layer, which may be pavers, rock, gravel, or the like (not shown), covering the membrane layer 56. Embedded in the roof structure, as between the insulation layer 54 and the membrane layer 56, or on top of the membrane layer 56, is the inductor plate 34, with the stem member 50 and capacitor 26 extending therefrom and to or through the insulation layer 54 (the latter shown in FIG. 3), with a distal end 58 of the water-absorptive capacitor 26 contacting an upper surface 60 of the roof substrate layer 52, or other water-impermeable element in the roof assembly.

In preparing for operation of the system disclosed herein, a number of the moisture sensors 14 are placed in the roof structure 16, as shown in FIG. 3 and described above. The length of the stem member 50 is selected such that the distal end 58 of the capacitor water absorptive material 32 is brought to bear against the surface 60 upon which moisture may accumulate. In some instances, the stem member 50 is omitted and the capacitor 26 depends directly from the underside of the inductor plate 34.

When an inspection for roof moisture is desired, the transmitter 10 is caused to transmit a series of short pulses of several KW peak power. The pulses 12 are sent at the frequency at which the autonomous sensors 14 are resonant. Upon receiving the pulses 12, the sensors 14 resonate at one frequency when dry and at a distinctly different frequency when wet. Wetting of the absorptive material 32 changes the dielectric constant of the capacitor 26 and shifts the resonant frequency of the sensor circuit. The radio receiver and analyzer 20 detects the resonant signals of the sensors 14 and generates a report, or display, indicating whether there are any sensors 14 that are resonating at a frequency different from that of the dry sensors, thereby indicating probable wetting of the roof. When the roof dries out, the absorptive material 32, in due course, also dries and the affected sensor thereafter resonates "dry" signals, rather than "wet" signals, until the sensor capacitor is again wetted.

The transmitter 10 and receiver 20 may be permanent installations or portable devices, and may be combined into a single unit.

Figure 4:
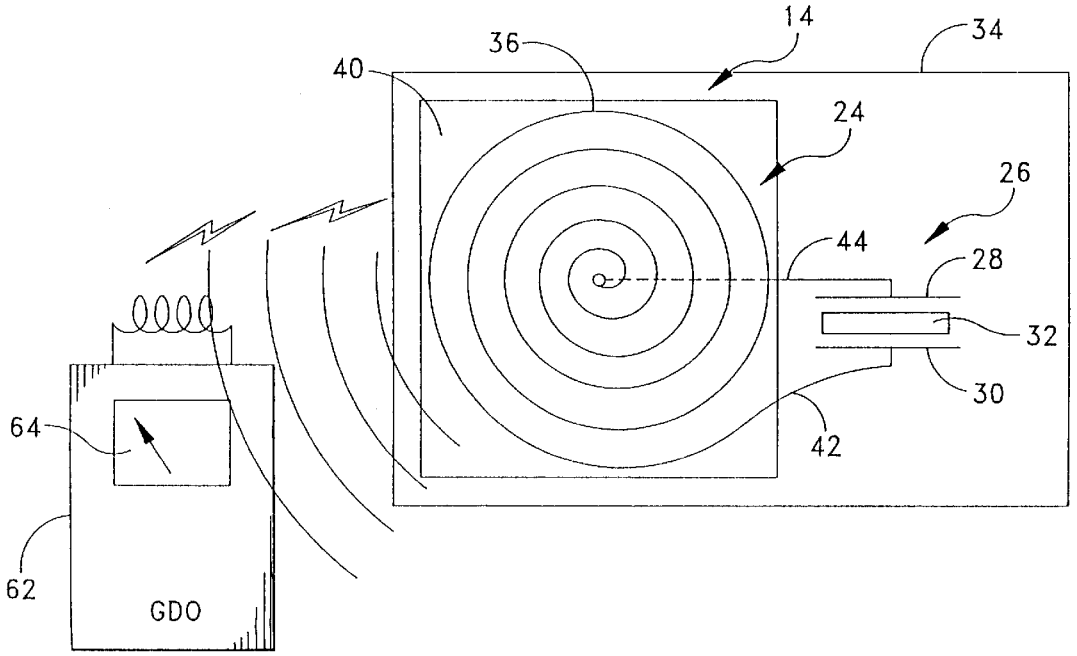
FIG. 4 is a diagrammatic representation of another form of roof moisture sensing sensor and system illustrative of an alternative embodiment of sensor, as well as a system which may be used as an alternative system or may be used in combination with the system of FIG. 1.

In FIG. 4, there is shown an alternative embodiment in which the capacitor 26 and inductor 24 are both disposed in or on the plate 34. The induction coil is covered by the plastic film 40, but not the capacitor 26. The FIG. 4 embodiment of sensor is well adapted for detection of moisture on or near a roof surface, and operates in the same manner as the embodiment shown in FIGS. 2 and 3.

There is thus provided a roof moisture sensor system facilitating quick and easy inspection from the ground of roof areas for moisture accumulation. There is further provided such a system which can be used time and time again, without requiring continuous replacement of parts and without attention between uses to be maintained in an active condition.

Once it is determined that a portion of the roof structure 16 is wet, a gate dip oscillator 62 (FIG. 4) may be used to pinpoint areas of concern. The gate dip oscillator 62 (GDO) is pre-tuned to emit RF energy at the resonant frequency of a dry roof moisture sensor. However, as sensor absorptive materials 32 become wet, the dielectric constant of the material increases. With the increase in the dielectric constant, the resonant frequency of the sensor decreases from the dry sensor resonant frequency.

In practice, after the receiver analyzer 20 indicates that there is an accumulation of moisture in the roof structure, the oscillator 62 is manually passed in close proximity over individual sensors. A dip in gate current, indicated in a display 64 on the oscillator 62, indicates a dry sensor, while no dip indicates a wet sensor. Rather than a needle-type display 64, as shown in FIG. 4, the display may be a light signal and/or audible signal.

The oscillator 62 may, of course, be used initially to inspect the roof structure 16, at less expense than the transmitter-receiver system, but requires personnel on the roof and requires time for individual checks of each sensor. In practice, it has been found preferable to use the transmitter-receiver system to complete an inspection virtually instantly without having to physically access the roof top, and follow, only when necessary, with an inspection by oscillator of each sensor. The receiver in the first-described system advises as to the presence of a leak and as to the general whereabouts of the sensors indicating the leak. The follow-up oscillator inspection, conducted only when warranted, provides an accurate sensor-by-sensor plot of exactly where the leak is and the path of the water in the roof structure. Thus, the transmitter-receiver system facilitates quick and easy inspections which, in most cases, is all that is needed. Such inspections can be followed by the more precise oscillator-based inspections when required.

While the oscillator 62 is shown in use with the FIG. 4 embodiment of sensor, it will be apparent that the oscillator finds equal utility in combination with the embodiment of sensors shown in FIGS. 2 and 3.

It is to be understood that the present invention is by no means limited to the particular constructions and methods herein disclosed and/or shown in the drawings, but also comprises any modifications or equivalents within the scope of the claims.

Having thus described our invention, what we claim as new and desire to secure by Letters Patent of the United States is:

1. A roof moisture sensing system comprising:

a radio frequency pulse transmitter;

a passive moisture sensor disposed on a roof; and a radio receiver adapted to monitor resonance of said moisture sensor activated by a pulse transmitted by said pulse transmitter, said receiver being adapted to analyze said resonance of said sensor to determine both presence and absence of moisture in said sensor;

said transmitter and said receiver being remote from said sensor and said roof.

2. The sensing system in accordance with claim 1 wherein said moisture sensor comprises an inductor and a capacitor.

3. The sensing system in accordance with claim 2 wherein said capacitor comprises first and second electrodes and water-absorptive material disposed therebetween.

4. The sensing system in accordance with claim 3 wherein said inductor comprises a substantially planar plate having an induction coil thereon.

5. The sensing system in accordance with claim 4 wherein said inductor further comprises a plastic film encasing said induction coil.

6. The sensing system in accordance with claim 4 wherein said first and second electrodes of said capacitor are in electrical communication, respectively, with first and second ends of said induction coil.

7. The sensing system in accordance with claim 4 wherein said capacitor extends normal to said plate.

8. The sensing system in accordance with claim 7 and further comprising a stem interconnecting said plate and said capacitor.

9. The sensing system in accordance with claim 6 wherein said capacitor is fixed to said plate.

10. The sensing system in accordance with claim 9 wherein said inductor further comprises a plastic film encasing said induction coil.

11. A roof moisture sensing system comprising:

a radio frequency power emitter for emitting radio frequency power at a selected frequency;

a moisture sensor disposed on a roof and adapted to resonate at said frequency when said sensor is dry;

said emitter having means for indicating matching of said emitted power frequency and said sensor resonant frequency and thereby indicating dryness of said sensor, and for indicating lack of said matching of said frequencies to thereby indicate wetness of said sensor.

12. The system in accordance with claim 11 wherein said emitter comprises a gate dip oscillator.

13. A method for determining the presence of moisture in a roof structure, said method comprising the steps of:

providing a moisture sensor on said roof structure, said moisture sensor comprising an inductor and a capacitor, said capacitor comprising first and second electrodes and water-absorptive material disposed therebetween, said inductor comprising an induction coil, said first and second electrodes being in electrical communication with first and second ends of said induction coil, said capacitor being adapted to change the resonant frequency of said sensor in response to wetting of said capacitor water-absorptive material;

directing radio frequency power at said sensor to actuate resonance of said sensor; and monitoring resonant frequency signals emitted by said sensor to determine thereby whether said sensor is dry or wet.

14. The method in accordance with claim 13 wherein said directing of radio frequency power at said sensor is accomplished by use of a radio transmitter, and said monitoring of said resonant frequency signals emitted by said sensor is accomplished by use of a radio receiver and signal analyzer to make said determination as to whether said sensor is dry or wet.

15. The method in accordance with claim 13 wherein said directing of radio frequency power at said sensor is accomplished by use of a gate dip oscillator, and said monitoring of said resonant frequency signals emitted by said sensor is accomplished by said oscillator.

* * * * *